United States Patent [19]

Masuda et al.

[11] 4,152,162

[45] May 1, 1979

[54] THERMALLY DEVELOPABLE LIGHT-SENSITIVE MATERIALS

[75] Inventors: Takao Masuda; Shinpei Ikenoue; Tomoyuki Kobayashi, all of Asaka, Japan

[73] Assignee: Fuji Photo Film Co., Ltd., Minami-ashigara, Japan

[21] Appl. No.: 831,825

[22] Filed: Sep. 9, 1977

[30] Foreign Application Priority Data

Sep. 16, 1976 [JP] Japan ..... 51-111124

[51] Int. Cl.[2] ..... G03C 1/02

[52] U.S. Cl. ..... 96/114.1; 96/48 HD

[58] Field of Search ..... 96/114.1, 67

[56] References Cited

U.S. PATENT DOCUMENTS

| | | | |
|---|---|---|---|
| 3,782,941 | 1/1974 | Hartman et al. | 96/114.6 |
| 3,887,597 | 6/1975 | Ohkubo et al. | 96/114.1 |
| 3,933,507 | 1/1976 | Von Konig et al. | 96/127 |

OTHER PUBLICATIONS

Richter, Textbook of Organic Chemistry, pp. 136–139, John Wiley & Sons, New York, (1952).

*Primary Examiner*—J. Travis Brown

*Attorney, Agent, or Firm*—Sughrue, Rothwell, Mion, Zinn and Macpeak

[57] ABSTRACT

A thermally developable light-sensitive material comprising a support having therein or thereon a mixture of (a) an organic silver salt and (b) a photocatalyst, wherein the organic silver salt (a) is a mixture of (i) at least one organic silver salt selected from the group consisting of silver stearate, silver arachidate, silver behenate and silver lignocerate and (ii) at least one organic silver salt of straight chain aliphatic carboxylic acid having an odd number of 25 or more carbon atoms in an amount of about 5 mol % to about 50 mol % based on the organic silver salt (i), and additionally (c) a reducing agent with the mixture of the organic silver salt (a) and photocatalyst (b) or adjacent the mixture of the organic silver salt (a) and the photocatalyst (b).

5 Claims, No Drawings

THERMALLY DEVELOPABLE LIGHT-SENSITIVE MATERIALS

BACKGROUND OF THE INVENTION

1. Field of the Invention

The present invention relates to thermally developable light-sensitive materials and particularly to thermally developable light-sensitive materials having a low heat-fogging property, an excellent shelf-life and an improved stability.

2. Description of the Prior Art

Photographic processes using silver halide have been most widely employed heretofore, since such have excellent photographic properties such as sensitivity or gradation as compared to electrophotographic processes or diazo photographic processes. However, silver halide light-sensitive materials used in such a silver halide photographic process are subjected to a development processing using a developing solution after imagewise exposure to light and they are then subjected to several processings in baths such as stopping, fixing, water washing and stabilization, etc. so that the resulting images do not rapidly discolor or fade under normal room light or so that the undeveloped white areas (background) do not blacken. Accordingly, there are many problems because the processings require much time and labor, the handling of chemicals is hazardous, the processing room and the body or clothing of workers are stained or environmental pollution occurs when the processing solutions are discharged in rivers. Therefore, high speed photosensitive materials using silver halide which can be processed in a dry state without processing with solutions, in which the processed images are stable and the background discolors less under normal room light have been desired.

Thus, various approaches have been made up to now. For example, as described in German Pat. Nos. 1,123,203 and 1,174,157, 3-pyrazolidone type developing agents are incorporated in the silver halide emulsions, by which it becomes possible to develop by heating. Further, German Pat. No. 1,003,578 describes the incorporation of 3-pyrazolidone type developing agents together with a fixing agent for silver halide. However, using these techniques, it is not possible to completely stabilize the remaining silver halide to light after processing the photosensitive matierals in the dry state. Namely, German Pat. Nos. 1,123,203 and 1,174,157 do not describe fixing in the dry processing. Further, it appears that a practical use of the approach disclosed in German Pat. No. 1,003,578 is difficult, because it is presumed that undesirable reactions occur during storage because of the presence of the developing agent (reducing agent) in combination with the fixing agent.

At the present time, one of the most successful light-sensitive materials capable of forming photographic images by dry processing is a thermally developable light-sensitive material utilizing a composition consisting essentially of an organic acid silver salt, a small amount of a photocatalyst such as silver halide and a reducing agent, which is described in U.S. Pat. Nos. 3,152,904 and 3,457,075. In this photosensitive material, although the photocatalyst remaining in the light-sensitive material after development, such as silver halide, etc., is allowed to discolor by exposure to light without stabilizing to light, the same effects as in the case of stabilizing to light can be obtained. This is because the amount of the photocatalyst used, such as silver halide, is small and the greater part of the composition is composed of a white or lightly colored lightstable organic silver salt which is difficultly blackened by light and, consequently, even if the small amount of the photocatalyst such as silver halide is discolored by light, the light-sensitive material looks white or lightly colored on the whole, and such a slight discoloration hardly interferes with use of the material. This photosensitive material is stable at normal temperature (e.g., 25° C. or less) but when the material is heated to about 80° C. or more and preferably 100° C. or more, the organic silver salt oxidizing agent and the reducing agent in the light-sensitive layer undergo an oxidation-reduction reaction due to the catalytic function of the photocatalyst such as exposed silver halide present in the vicinity to yield silver, by which the exposed areas of the light-sensitive layer rapidly blacken to form a contrast between the exposed areas and unexposed areas (background) and thus the images are formed.

Further, in this kind of thermally developable light-sensitive material, it is possible to use photosensitive complexes of silver and dyes, as described in Japanese Patent Application (OPI) 4728/71, U.S. Pat. No. 3,933,507 and Japanese Patent Publication 25498/74, as the photocatalyst instead of the above described silver halide.

The present invention relates to an improvement of the above described thermally developable light-sensitive materials and has been acheved in order to obtain effects described hereinafter by using a specific combination of organic silver salts.

The following compounds are known as organic silver salts used for such thermally developable light-sensitive materials.

(i) Silver salts of organic compounds containing an imino group described in Japanese Patent Applications 91214/74, 28221/73 and 91215/74 and U.S. Pat. Nos. 3,152,904 and 3,457,075 (for example, silver saccharin, silver benzotriazole or silver N-phthalimide, etc.).

(ii) Silver salts of organic compounds containing a mercapto group or a thione group described in Japanese Patent Applications (OPI) 52626/74 and 10039/74 (for example, silver 2-mercaptobenzoxazole or silver 3-(2-carboxyethyl)-1-phenyl-1,3,4-triazoline-2-thione, etc.).

(iii) Silver salts of organic compounds containing a carboxyl group described in U.S. Pat. Nos. 3,457,075, 3,330,663 and 3,667,958, Japanese Patent Publications 49498/74 and 18808/74, Japanese Patent Applications (OPI) 6077/71, 97523/73, 10282/72, 238/72 and 4728/71 and German Patent Application (OLS) 2,308,766 (for example, silver salts of aliphatic carboxylic acids such as silver caprylate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate, etc. and silver salts of aromatic carboxylic acids such as silver 3,5-dihydroxybenzoate, silver o-methylbenzoate, silver m-methylbenzoate, silver p-methylbenzoate, silver 2,4-dichlobenzoate, silver acetamidobenzoate, silver p-phenylbenzoate, silver gallate, silver tannate, silver phthalate, silver terephthalate, silver salicylate, silver phenylacetate, silver pyromellitate and the silver salt of 4'-n-octadecyloxydiphenyl-4-carboxylic acid, etc.).

(iv) Silver sulfonates (for example, silver ethanesulfonate or silver 1-propanesulfonate, etc.), silver sulfinates (for example, silver p-toluenesulfinate) and silver salts of tetrazaindenes described in British Pat. No. 1,230,642 and Japanese Patent Application (OPI) 89720/73.

In using silver halide (or silver-dye photosensitive complexes as described hereinafter) as the photocatalyst, organic silver salts comparatively stable to light are suitably used and particularly silver salts of aliphatic acids having 18 or more carbon atoms such as silver stearate, silver behenate, silver arachidate or silver lignocerate have been used.

Particularly, silver behenate is suitably used, because it is inexpensive since naturally occurring behenic acid can be utilized and silver behenate is stable to light and heat.

However, in prior thermally developable light-sensitive materials using silver behenate, there are problems because light stability is somewhat insufficient, heat fog (undesirable fog caused on heating the unexposed areas) easily occurs and the photographic properties of the thermally developable light-sensitive materials after storage for a long period of time are remarkably poorer than those of the thermally developable light-sensitive materials just after the preparation thereof. Those thermally developable light-sensitive materials whose photographic properties deteriorate during storage are described as having a poor "shelf-life".

Hitherto, various means have been employed in order to improve the shelf-life. A method which comprises processing the thermally developable light-sensitive materials in a dark place (for example, in a refrigerator) is one such means. A method is also known which comprises adding suitable additives such as an acid stabilizer or a certain kind of antifogging agent, etc. to the thermally developable light-sensitive material to prevent the occurrence of fog or a deterioration of the sensitivity during storage. However, sufficient improvement of the shelf-life can not be obtained using these means. Hitherto, a method effective in preventing the occurrence of fog or reducing the deterioration of the image density or the color tone obtained by processing the thermally developable light-sensitive materials after storage has not been found. Further, in prior thermally developable light-sensitive materials, the effect of the color toning agent used to improve the color tone of the images deteriorates and results in the above-described deterioration of the color tone.

SUMMARY OF THE INVENTION

The objects of the present invention are to provide a specific technique for minimizing or eliminating heat fogging, improving light stability and improving the shelf-life of the above described thermally developable light-sensitive materials and to provide thermally developable light-sensitive materials wherein the image density is deteriorated less, the color tone of the images is deteriorated less and fog occurs to a lesser extent even though the materials are stored for a long period of time.

As a result of various studies relative to the above described objects, it has now been found that the shelf-life can be unexpectedly improved by using silver salts of straight chain aliphatic carboxylic acids having an odd number of 25 or more carbon atoms together with silver salts of aliphatic carboxylic acids having an even number of carbon atoms, namely, silver stearate ($C_{18}$), silver arachidate ($C_{20}$) silver behenate ($C_{22}$) or silver lignocerate ($C_{24}$).

Namely, the present invention provides a thermally developable light-sensitive material comprising a support having therein or thereon a mixture of (a) an organic silver salt and (b) a photocatalyst, wherein the organic silver salt (a) is a mixture of (i) at least one organic silver salt selected from the group consisting of silver stearate, silver arachidate, silver behenate and silver lignocerate and (ii) at least one organic silver salt of a straight chain aliphatic carboxylic acid having an odd number of 25 or more carbon atoms in an amount of about 5 mol % to about 50 mol % based on the organic silver salt (i), and additionally (c) a reducing agent with the mixture of the organic silver salt (a) and the photocatalyst (b) or adjacent the mixture of the organic silver salt (a) and the photocatalyst (b).

DETAILED DESCRIPTION OF THE INVENTION

The organic silver salt of a straight chain aliphatic acid having an odd number of carbon atoms as component (ii), for brevity, is hereinafter called an odd carboxylic acid silver salt.

Although the maximum number of carbon atoms in the odd carboxylic acid silver salts is not limited, it is preferred to use odd carboxylic acid silver salts having up to 41 carbon atoms and particularly up to 31 carbon atoms because the solubility of such salts in solvents such as toluene or xylene decreases as the number of carbon atoms increases. Of course, it is possible to use odd carboxylic acid silver salts having more than the above described number of carbon atoms by appropriately selecting the solvent used in preparing the silver salt.

Such odd carboxylic acid silver salts are represented by the general formula $$C_{2n}H_{4n+1}COOAg$$

wherein n is an integer of 12 to 20. Examples of such carboxylic acid silver salts include $C_{24}H_{49}COOAg$, $C_{26}H_{53}COOAg$, $C_{28}H_{57}COOAg$, $C_{30}H_{61}COOAg$, $C_{32}H_{65}COOAg$, $C_{34}H_{69}COOAg$, $C_{36}H_{73}COOAg$, $C_{38}H_{77}COOAg$ and $C_{40}H_{81}COOAg$, etc.

Of these odd carboxylic acid silver salts, those having 25 or more carbon atoms are advantageously used, because they exhibit a remarkable improvement in shelf-life.

In using silver behenate, if an odd carboxylic acid silver salt having 21 or 23 carbon atoms is used together therewith, heat fog easily occurs and the light stability is less improved, although the shelf-life is highly improved. Accordingly, the effects achieved as compared to those having 25 or more carbon atoms are not as good.

Straight chain aliphatic carboxylic acids having an odd number of 25 or more carbon atoms (hereinafter, called odd carboxylic acids for brevity) as starting materials for preparing the odd carboxylic acid silver salts used in the present invention can be synthesized using various known processes. Examples of suitable processes for synthesizing odd carboxylic acids are as follows. For example, one process comprises heating a straight chain saturated alcohol having an odd number of carbon atoms in the presence of iodine and red phosphorus to prepare a corresponding odd carboxylic acid. Further, another process comprises reacting a straight chain saturated alkyl halide (having the general formula (II) described below) with an acid chloride (having the general formula (III) described below) in the presence of a suitable catalyst (for example, a copper-zinc alloy, etc.), hydrolyzing the keto-ester produced with a metal hydroxide (for example, sodium hydroxide or potassium hydroxide, etc.) to produce a keto-acid and carrying out a Clemensen reduction of the keto-acid to produce the desired straight chain aliphatic carboxylic acid having an odd number of carbon atoms (having the general formula (I) described below), as described in F. L. Breusch, F. Boykut and S. Özeris, *Fette, Seifeu, Austrichmittel* 61, 891–893 (1956) (*Chemical Abstracts,* 54, 22339i(1960).

$$CH_3(CH_2)_n X \quad \text{(II)}$$

$$X-\overset{\overset{\displaystyle O}{\|}}{C}-(CH_2)_m COOR \quad \text{(III)}$$

$$CH_3(CH_2)_nCH_2(CH_2)_mCOOH \quad \text{(I)}$$

In the above formulae, X represents a halogen atom such as Cl, Br, I, etc., n and m each represent natural numbers satisfying the relationship $n + m = 2l + 16$ (wherein l represents a natural number of 1, 2, . . .), and R represents a hydrogen atom or a lower alkyl group (e.g., a methyl group, an ethyl group, etc.).

Some examples of odd carboxylic acids which can be prepared using such known processes and the melting points thereof are as follows: $C_{24}H_{49}COOH$ (melting point: 83–83.8° C.), $C_{26}H_{53}COOH$ (melting point: 86°–87° C.) and $C_{28}H_{57}COOH$ (melting point: 90°–90.7° C.).

Hereinafter, both component (a) (i) and component (a) (ii) will be generically described, without distinction, therebetween, as simply "carboxylic acid silver salts", and the carboxylic acids therein will be generically described without distinction therebetween, as simply "carboxylic acids".

In order to prepare carboxylic acid silver salts of component (a) used in the present invention, various processes for preparing organic silver salts known in the field of thermally developable light-sensitive materials may be utilized. The simplest process is the process as described in U.S. Pat. No. 3,457,075, which comprises mixing a colloidal dispersion of an ammonium salt or alkali metal salt of a carboxylic acid with an aqueous solution of a water soluble silver salt such as silver nitrate. In a similar process, it is possible to use an aqueous solution of a silver complex salt such as a silver ammine complex salt or a solution of such a silver complex salt in a water miscible solvent instead of the aqueous solution of the water soluble silver salt. Another process is the process described in U.S. Pat. No. 3,458,544. Namely, this process comprises mixing an oily solution of carboxylic acids in a water immiscible solvent such as toluene or xylene with an aqueous solution of a silver complex salt to prepare the carboxylic acid silver salt. Water is preferably added to the oily solution to form an emulsion before admixing the aqueous solution of the silver complex salt.

A further process for preparing carboxylic acid silver salts is the process described in Japanese Patent Application (OPI) 94619/74 (corresponding to U.S. Pat. No. 3,960,908). Namely, this process comprises mixing an emulsion of an aqueous solution of an alkali metal salt or ammonium salt of a water-soluble carboxylic acid and a water-immiscible solvent (for example, benzene, toluene, cyclohexane, pentane, hexane, esters of carboxylic acids such as acetates, phosphoric acid esters or castor oil, etc.) with a silver salt (silver nitrate, etc.) which is more soluble than the organic silver salt or a silver compex salt as, preferably, an aqueous solution to prepare the carboxylic acid silver salt. A modification of this process is a process which comprises mixing an alkaline aqueous solution of a carboxylic acid with an oily solution (for example, a solution in toluene) to prepare an emulsion and mixing the emulsion with an aqueous solution, preferably, of a soluble silver salt such as silver nitrate or a silver complex salt such as a silver ammine complex salt to prepare the carboxylic acid silver salt.

Alkali soluble silver complex salts having a higher dissociation constant than carboxylic acid silver salts, such as silver amine complex salt, silver methylammine complex salt or silver ethylammine complex salt, etc. are advantageously used as the silver complex salts. For the solution of silver salts such as silver nitrate, polar solvents such as dimethyl sulfoxide, dimethylformamide or acetonitrile, etc. may be used, also in addition to water. Further it is possible to utilize the process described in Japanese Patent Application (OPI) 93310/74, which comprises applying supersonic waves during preparation of the organic silver salts. Particularly, in cases of emulsifying water and oils, emulsification can be easily carried out using supersonic waves. In order to control the particle size, surface active agents may be used in the preparation of the carboxylic acid silver salts. The carboxylic acid silver salts may be prepared in the presence of polymers. As a special process, it is possible to utilize the process described in U.S. Pat. No. 3,700,458, which comprixes mixing a nonaqueous solution of carboxylic acids with a nonaqueous solution of a silver salt of trifluoroacetic acid or tetrafluoroboric acid in the presence of a polymer such as polyvinyl acetal to produce carboxylic acid silver salts.

Further, it is possible to change the particle form or the particle size of the carboxylic acid silver salts or photographic properties such as tendency toward heat fogging, light stability or sensitivity, etc. by incorporating a metal salt or a metal complex salt, such as compounds of chromium, mercury, lead, cobalt, manganese, nickel, iron or cerium, etc., during the preparation of the carboxylic acid silver salts. A preferred amount of the metal containing compounds ranges from about $10^{-6}$ to about $10^{-1}$ mol per mol of the carboxylic acid silver salts and about $10^{-5}$ to about $10^{-2}$ mol per mol of the silver halide.

The carboxylic acid silver salts of the present invention, of course, may be prepared using processes other than the above described processes.

The particle size of the carboxylic acid silver salts thus obtained is about 10 microns to about 0.01 microns (length) and preferably about 5 microns to about 0.1 micron.

The amount of the carboxylic acid silver salts used in the thermally developable light-sensitive materials of the present invention is difficult to set forth, because it depends upon the type of photocatalyst of component (b) used. However, in using a photosensitive silver halide or a photosensitive silver halide forming component (to be described hereinafter) as the photocatalyst of component (b), since a preferred amount of the thermally developable light-sensitive layer applied on the support is in the range of about 0.2g to 3g, and particularly a range of about 0.3 to about 2g, per $m^2$ of the support, it is preferred for the amount of the component (a) to be adjusted so as to be within the above described range.

The two types of carboxylic acid silver salts used in the present invention may be mixed after their preparation respectively using the above described various processes. Alternatively, both carboxylic acids as starting materials may be previously mixed before preparation of the silver salts thereof, if desired.

A preferred ratio for obtaining the effects of the present invention is in the range of about 5 mol% to about 50 mol% and more preferably a range of 20 mol% to 40 mol% of the odd carboxilic acids of component (ii) based on the total amount of silver stearate, silver arachidate, silver behenate or silver lignocerate as component (i) (and if a mixture, the total of the mixture thereof). If the amount of component (ii) is too small, the effects of the present invention are not achieved. If the amount of component (ii) is too large, the development tends to be restricted. However seriously adverse effects do not occur if a larger amount of component (ii) is used.

Setting aside why the objects of the present invention are attained by using the combination of the carboxylic acid silver salts, the following fact is very surprising in view of extensive experience in this field. Namely, by use of the combination of carboxylic acid silver salts of the present invention, the heat fogging occurs to a lesser extent, light stability increases and the shelf life is improved in thermally developable light-sensitive materials.

Component (b) of the present invention renders the thermally developable light-sensitive materials light sensitive and serves as a catalyst for carrying out an oxidation-reduction image forming reaction between the organic carboxylic acid silver salts component (a) and reducing agent component (c).

Component (b) used in the present invention is, preferably, a light sensitive silver halide, examples of which include silver chloride, silver bromide, silver iodide, silver iodobromochloride, silver bromochloride, silver iodochloride, silver bromochloride or mixtures thereof. A suitable amount of the light-silver halide ranges from about 0.001 mol to about 0.7 mol and preferably about 0.01 mol to about 0.5 mol per mol of the organic silver salt (a). A preferred particle size of the silver halide ranges from about 2 microns to about 0.001 micron (length) and preferably about 0.5 micron to about 0.01 micron. The light sensitive silver halide can be prepared as an emulsion using suitable known processes in the photographic art such as the single jet method or the double jet method. For example, Lipmann emulsions, ammonia process emulsions, thiocyanate or thioether ripened emulsions, etc. can be used. A previously prepared light sensitive silver halide (b) can be mixed with an oxidation-reduction composition of the organic silver salts (a) and the reducing agent (c). This is described in U.S. Pat. No. 3,152,904. Various attempts have been made for the purpose of sufficiently contacting the silver halide (b) with the organic silver salts (a). One technique comprises adding a surface active agent, which is described in, for example, U.S. Pat. No. 3,761,273 and Japanese Patent Applications (OPI) 32926/75 and 32928/75. Another process comprises mixing a silver halide prepared in the presence of a polymer with the organic salts, and is described, for example, in U.S. Pat. Nos. 3,706,565, 3,706,564 and 3,713,833 and British Pat. No. 1,362,970, etc.

A further process comprises mixing a silver halide emulsion after enzymatic decomposition thereof with the organic silver salts, as described in British Pat. No. 1,354,186. The silver halide used in the present invention can be prepared simultaneously with the formation of the organic silver salts as described in Japanese Patent Application 17216/75. Another process, comprises forming a light-sensitive silver halide in a part of the organic silver salts by reacting a light-sensitive silver halide forming component (to be described hereinafter) as component (b) with a previously prepared solution or dispersion of the organic silver salts (a) or with a sheet which contains the organic silver salts (a). The thus-formed silver halide effectively contacts the organic silver salts and exhibits suitable activity as described in U.S. Pat. No. 3,457,075.

On the other hand, components capable of forming light-sensitive silver halide, as component (b), are compounds which react with the organic silver salts (a) to form silver halide. Whether the compound is effective or not as a silver halide forming component can be determined using the following simple routine test. More specifically, after the silver halide forming component has been reacted with the organic silver salt and, if necessary, heated, the product is analyzed using X-ray diffraction analysis to determine whether diffraction peaks specific to silver halide are present.

Suitable conditions for forming the silver halide are as follows.

The reaction temperature is in the range of about −80° C. to about 100° C. and preferably about −20° C. to about 70° C. The reaction time is in the range of about 0.01 second to about 150 hours and preferably about 0.1 second to about 72 hours. The reaction pressure is in the range of about $10^{-2}$mm Hg to about 300 atm. and preferably at atmospheric pressure.

Components capable of forming light-sensitive silver halide, useful as component (b), include inorganic halides, halogen containing metal complexes, onium halides, halogenated hydrocarbons, N-halo compounds and other halogen containing compounds. Examples of these components are described in detail in Japanese Patent Application (OPI) 22431/76, U.S. Pat. No. 3,457,075 and Japanese Patent Applications (OPI) 78316/75, 115027/75 and U.S. Pat. No. 4,003,749. Some examples of silver halide forming components are described below.

(1) Inorganic halides:

For example, halides represented by $MX_{n'}$ (wherein M represents H, $NH_4$ or a metal atom, X represents Cl, Br or I, and n' is 1 when M represents H or $NH_4$ and is the valence of the metal atom when M represents the metal atom. Examples of suitable metal atoms are lithium, sodium, potassium, rubidium, cesium, copper, gold, beryllium, magnesium, calcium, strontium, barium, zinc, cadmium, mercury, aluminum, gallium, indium, lanthanum, ruthenium, thallium, germanium, tin, lead, antimony bismuth, chromium, molybdenum, tungsten, manganese, rhenium, iron, cobalt, nickel, ruthenium, rhodium, palladium, osmium, iridium, platinum and cerium, etc.).

(2) Halogen containing metal complexes

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

(3) Onium halides

For example, quaternary ammonium halides such as trimethylammonium bromide, cetylethyldimethylammonium bromide or trimethylbenzylammonium bromide, etc.; quaternary phosphonium halides such as tetraethylphosphonium bromide; and tertiary sulfonium halides such as trimethylsulfonium iodide.

(4) Halogenated hydrocarbons

For example, iodoform, bromoform, carbon tetrabromide and 2-bromo-2-methylpropane, etc.

(5) N-halo compounds

N-chlorosuccinimide, N-bromosuccinimide, N-bromophthalimide, N-bromoacetamide, N-iodosuccinimide, N-bromophthalazone, N-bromooxazoline, N-chlorophthalazone, N-bromoacetanilide, N,N-dibromobenzene sulfonamide, N-bromo-N-methylbenzenesulfonamide, 1,3-di-bromo-4,4-dimethylhydantoin and trichloroisocyanuric acid, etc.

(6) Other halogen-containing compounds

Triphenylethyl chloride, triphenylmethyl bromide, 2-bromobutyric acid, 2-bromoethanol, dichlorobenzophenone and triphenylbromide, etc.

Two or more of the silver halide forming components may be used in combination, if desired, in the above described various processes. The amount of the silver halide forming component is in the range of about 0.001 mol to about 0.7 mol and preferably about 0.01 mol to about 0.5 mol of the organic silver salts (a). If the amount is less than about 0.001 mol, the sensitivity is reduced. If the amount is larger than about 0.7 mol, discoloration by light (undesirable coloration of the background formed when the processed sensitive material is allowed to stand under normal room illumination) increases.

Regardless of the method used, the silver halide can be sensitized with, for example, sulfur containing compounds, gold compounds, platinum compounds, palladium compounds, silver compounds, tin compounds or combinations thereof. These techniques are described in Japanese Patent Applications 115386/74, 122902/74, 143178/74, 13074/75, 45646/75 and 81181/75.

It is possible to use other photocatalysts instead of the silver halide. For example, it is possible to use light sensitive complexes of silver and dyes as described in Japanese Patent Publication 25498/74 and Japanese Patent Applications (OPI) 4728/71 and U.S. Pat. No. 3,933,507 as photocatalysts. In addition, it is possible to use metal diazosulfonates and sulfinates as described in U.S. Pat. No. 3,152,904 as photocatalysts. Moreover, photoconductive materials such as zinc oxide or titanium oxide, etc. can be used. For thermally developable light-sensitive materials having a high sensitivity, silver halide is most preferred as the photocatalyst.

Further, some types of spectral sensitizing dyes effective for gelatin-silver halide emulsions can also be used to sensitize the thermally developable light-sensitive materials of the present invention. Examples of effective spectral sensitizing dyes include cyanine dyes, merocyanine dyes, rhodacyanine dyes, complex (trinuclear or tetranuclear) cyanine or merocyanine dyes, holopolar cyanine dyes, styryl dyes, hemicyanine dyes, oxonol dyes, hemioxonol dyes and xanthene dyes, etc. In the cyanine dyes, those containing a basic nucleus such as a thiazoline nucleus, an oxazoline nucleus, a pyrrole nucleus, a pyridine nucleus, an oxazole nucleus, a thiazole nucleus, a selenazole nucleus or an imidazole nucleus are more preferred. Particularly, cyanine dyes having a carboxyl group or an imino group can be effectively used. The merocyanine dyes may contain an acid nucleus such as a thiohydantoin nucleus, a rhodanine nucleus, an oxazolidinedione nucleus, a thiazolidinedione nucleus, a barbituric acid nucleus, a thiazolinone nucleus, a malononitrile nucleus or a pyrazolone nucleus in addition to the above-described basic nucleus. Particularly, merocyanine dyes having an imino group or a carboxyl group can be effectively used.

Examples of sensitizing dyes which are particularly effective for the thermally developable light-sensitive materials of the present invention include merocyanine dyes containing a rhodanine nucleus, a thiohydantoin nucleus or a 2-thio-2,4-oxazolidinedione nucleus as described in U.S. Pat. No. 3,761,279 and Japanese Patent Applications (OPI) 105127/75 and 104637/75. In addition, it is possible to similarly use for the present invention trinuclear merocyanine dyes as described in U.S. Pat. No. 3,719,495, sensitizing dyes for silver iodide as described in Japanese Patent Application (OPI) 17719/74, styrylquinoline dyes as described in British Pat. No. 1,409,009, rhodacyanine dyes as described in U.S. Pat. No. 3,877,943, acid dyes such as 2',7'-dichlorofluorescein dye as described in Japanese Patent Applications (OPI) 96717/74 and 10232/74 and British Pat. No. 1,417,382 and merocyanine dyes as described in Japanese Patent Application (OPI) 156424/75 and Japanese Patent Application 101680/74.

The amount of these dyes is about $10^{-4}$ to about 1 mol per mol of the silver halide or the silver halide forming component, component (b).

The reducing agent, component (c), used in the present invention is, preferably, a compound capable of reducing the organic silver salts (component (a)) when heated in a presence of the photocatalyst (b) such as exposed silver halide. The reducing agent (c) chosen is based on the type or properties of the organic silver salts (a) used.

Suitable reducing agents include monophenols, polyphenols such as bis-, tris- or tetrakisphenols, mono- or bisnaphthols, di- or polyhydroxynaphthalenes, di- or polyhydroxybenzenes, hydroxymonoethers, ascorbic acids, 3-pyrazolidones, pyrazolidones, pyrazolones, reducing saccharides, phenylenediamines, hydroxylamines, reductones, hydroxamic acids, hydrazides, amidoximes and N-hydroxyureas, etc. examples of which have been described in Japanese Patent Application (OPI) 22431/76, U.S. Pat. Nos. 3,615,533, 3,679,426, 3,672,904, 3,751,252, 3,751,255, 3,782,949, 3,801,321, 3,794,488 and 3,893,863, Belgian Pat. No. 786,086, U.S. Pat. Nos. 3,770,448, 3,819,382, 3,773,512, 3,928,686, 3,839,048 and 3,887,378, Japanese Patent Applications (OPI) 15541/75 and 36143/75, U.S. Pat. No. 3,827,889, Japanese Patent Applications (OPI) 36110/75, 116023/75, 147711/75 and 23721/76 and Japanese Patent Applications 105290/74 and 126366/74.

Particularly preferred reducing agents are polyphenols, sulfonamidophenols and naphthols.

Preferred examples of the polyphenols are 2,4-dialkyl substituted orthobisphenols, 2,6-dialkyl substituted parabisphenols and mixtures thereof. Examples of polyphenols include 1,1-bis-(2-hydroxy-3,5-dimethylphenyl)-3,5,5-trimethylhexane, 1,1-bis-(2-hydroxy-3-t-butyl-5-methylphenyl)-methane, 1,1-bis-(2-hydroxy-3,5-di-t-butylphenyl)methane, 2,6-methylenebis-(2-hydroxy-3-t-butyl-5-methylphenyl)-4-methylphenol, 6,6'-benzylidene-bis-(2,4-di-t-butylphenol), 6,6'-benzylidene-bis-(2-t-butyl-4-methylphenol), 6,6'-benzylidene-bis-(2,4-dimethylphenol), 1,1-bis-(2-hydroxy-3,5-dimethylphenyl)-2-methylpropane, 1,1,5,5-tetrakis-(2-hydroxy-3,5-dimethylphenyl)-2,4-ethylpentane, 2,2-bis-(4-hydroxy-3,5-dimethylphenyl)propane, 2,2-bis-(4-hydroxy-3-methyl-5-t-butylphenyl)propane and 2,2-bis(4-hydroxy-3-methyl-5-t-butylphenyl)propane and 2,2-bis-(4-hydroxy-3,5-di-t-butylphenyl)propane, etc.

Preferred examples of naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl. Preferred examples of sulfonamidophenols include 4-benzenesulfonamidophenol, 2-benzenesulfonamidophenol and 2,6-dichloro-4-benzenesulfonamidophenol. In addition, other examples are described in detail in Japanese Patent Applications (OPI) 22431/76, 36110/75, 116023/75, 147711/75 and 23721/76, Japanese Patent Applications 105290/74 and 126366/74, Japanese Patent Application OPI) 15541/75 and U.S. Pat. Nos. 3,672,904 and 3,801,321.

In using phenylenediamines as the reducing agent, color images are obtained by using such together with a phenol type or an active methylene type color coupler as described in U.S. Pat. Nos. 3,531,286 and 3,764,328. Similarly, color images can be obtained according to U.S. Pat. No. 3,761,270.

Of the above-described reducing agents, particularly preferred reducing agents are mono-, bis-, tris- or tetrakisphenols containing alkyl groups such as a methyl group, an ethyl group, propyl group, an isopropyl group or a butyl group, e.g., a 2,6-di-t-butyl-phenol group, or acyl groups in at least one or both position adjacent the hydroxyl group on the aromatic nucleus, because they have the characteristics that they are stable to light and cause the less discoloration to occur.

Reducing agents decomposable by light and rendered inactive by light as described in U.S. Pat. No. 3,827,889 are preferred because discoloration by light does not occur when the light sensitive material is allowed to stand in a bright room after development, since they are decomposed or inactivated by light and reduction no longer occurs. Reducing agents decomposable by light include ascorbic acid or derivatives thereof, furoin, benzoin, dihydroxyacetone, glyceraldehyde, rhodizonic acid tetrahydroxyquinone, 4-methoxy-1-naphthol and aromatic polysulfide compounds described in Japanese Patent Application (OPI) 99719/75. If the thermally developable light-sensitive materials are produced using such reducing agents decomposable by light as described in U.S. Pat. Nos. 3,827,889 and 3,756,829, positive images can be directly obtained by imagewise exposure to light to decompose the reducing agent. Further, it is possible to use compounds which accelerate the decomposition by light of the reducing agents.

Suitable reducing agents are selected on the basis of the type (properties) of the organic silver salts (Component (a)). The selection of the reducing agent can be by producing a photosensitive material as described in the Examples given hereinafter and examining the photographic properties thereof, and a determination of whether the reducing agent is suitable or not can be made, which is a simple method for persons skilled in this art.

Although the amount of the reducing agent used in the present invention varies according to type of the organic silver salts or the reducing agent or other additives, present, the reducing agent is generally used in a range of about 0.05 mol to about 10 mols, and preferably about 0.1 to about 3 mols, per mol of the organic silver salts.

Two or more of the above described reducing agents can be used together, if desired.

Color toning agents may be used together with the reducing agents. Color toning agents are appropriately used where deep color images or, particularly, black images are desired. The amount of the color toning agent is in the range of about 0.0001 mol to about 2 mols and preferably about 0.0005 mol to about 1 mol per mol of the organic silver salts. Although preferred color toning agents depend upon the organic silver salts used and the reducing agents used, imino compounds are most generally used. Suitable color toning agents include phthalazinone, oxazinediones, cyclic imides, urazoles and 2-pyrazolin-5-ones, etc., examples of which are described in U.S. Pat. Nos. 3,846,136, 3,782,941, 3,844,797, 3,832,186, 3,881,938 and 3,885,967, British Pat. No. 1,380,795, Japanese Patent Applications (OPI) 151138/75, 91215/74, 67132/75, 67641/75, 114217/75, 32927/75 and 22431/76 and Japanese Patent Application 16128/76. Some specific examples thereof include phthalazinone, N-acetylphthalazinone, phthalimide, N-hydroxyphthalimide, benzoxazinedione and uracil.

When two or more of these color toning agents are used, the photographic properties such as shelf life, etc. are often improved.

Various methods can be employed in order to prevent heat fogging of the thermally developable light-sensitive materials of the present invention. One such method comprises using mercury compounds as described in U.S. Pat. No. 3,589,903. Mercury bromide, mercury iodide and mercury acetate are preferred mercury compounds. A second method for preventing heat fogging comprises using N-halo compounds as described in Japanese Patent Applications (OPI) 10724/74, 97613/74, 90118/74 and 22431/76, such as N-halosuccinimide or N-haloacetamide, etc. Another method for preventing heat fogging comprises using compounds as described in U.S. Pat. No. 3,885,968, Japanese Patent Applications 101019/75, 116024/75, 123331/75 and 134421/75 and Japanese Patent Applications 121631/74, 115781/74, 125037/74, 131827/74, 299/75, 28851/75 and 96155/75, such as lithium salts, peroxides, persulfates, rhodium salts, cobalt salts, palladium compounds, cerium compounds, sulfinic acids, thiosulfonic acids, disulfides, rhodinic acid, acidic polymers and isophthalic acid. Of these compounds, particularly preferred compounds are sodium benzenesulfinate, sodium p-toluenesulfinate, sodium benzenethiosulfonate, cerium compounds such as cerium nitrate or cerium bromide, palladium acetylacetone complex, rhodium acetylacetone complex, isophthalic acid and fatty acids. Other preferred examples are described in Japanese Patent Application (OPI) 22431/76.

Examples of compounds which are effective for preventing discoloration by light of the thermally developable light-sensitive materials of the invention after processing (the phenomenon that the unexposed areas of the light-sensitive materials after processing change color gradually when exposed to normal room light) include stabilizer precursors such as azole thioethers or blocked azolethiones as described in U.S. Pat. No.

3,839,041, tetrazolylthio compounds described in U.S. Pat. No. 3,700,457, light-sensitive halogen-containing organic oxidizing agents described in U.S. Pat. No. 3,707,377, halogen-containing compounds described in Japanese Patent Application (OPI) 119624/75 and U.S. Pat. No. 3,874,946, 1-carbamoyl-2-tetrazolin-5-thiones described in U.S. Pat. No. 3,893,859 and sulfur described in Japanese Patent Application (OPI) 26019/76 (corresponding to U.S. Pat. No. 4,036,650).

Each component used in the present invention is dispersed in at least one colloid used as a binder. Preferred binders are hydrophobic binders but hydrophilic binders may be used. These binders are transparent or semitransparent. For example, proteins such as gelatin, cellulose derivatives, polysaccharides such as dextran, natural materials such as gum arabic and synthetic polymers are suitable as binders. Preferred binders are described in Japanese Patent Application (OPI) 22431/76. Particularly preferred binders include polyvinyl butyral, polyvinyl acetate, ethylcellulose, polymethyl methacrylate, cellulose acetate butyrate, gelatin and polyvinyl alcohol. If desired, two or more binders may be used as a mixture thereof. The amount by weight of the binders to the organic silver salts of component (a) is about 10:1 to 1:10 and preferably about 4:1 - about 1:4.

Layers containing the components used in the thermally developable light-sensitive materials of the present invention and other layers can be applied to various types of supports which can be selected from many materials. Although any shape may be used, films, sheets, rolls or ribbns are usually used as supports from the standpoint of handling as information recording materials. Suitable materials for supports include synthetic resin films and sheets, glass, wool, cotton, paper and metals such as aluminum, etc. Examples of suitable synthetic resin films include cellulose acetate films, polyester films such as polyethyleneterephthalate films, polyamide films, polyimide films, cellulose triacetate films and polycarbonate films, etc. Examples of paper supports include photographic papers, printing papers such as coated paper or art paper, baryta paper, resin coated paper, water resistant paper, paper sized with a polysaccharide, etc. described in Belgian Pat. No. 784,615, pigmented paper containing titanium dioxide, etc., paper coated with an α-olefin polymer (for example, polyethylene, polypropylene or ethylene-butene copolymers, etc.), coated paper and paper previously processed with polyvinyl alcohol.

The thermally developable light-sensitive materials of the present invention may also have an antistatic layer, an electrically conductive layer, a metal deposited layer, a subbing layer or a back layer.

If desired, a top coat polymer layer may be provided on the light-sensitive layer in order to increase the transparency of the thermally developable light-sensitive layer and to improve the heat resistance of the film, as described in Belgian Pat. No. 798,367, U.S. Pat. Nos. 3,856,526, 3,856,527 and 3,933,508 and Japanese Patent Application (OPI) 128726/74. It is preferred for the top coat polymer layer to have film thickness of about 1 micron to about 20 microns. Polymers suitable for the top coat polymer layer are polyvinyl chloride, copolymers of vinyl chloride and vinylidene chloride, polyvinyl acetate, copolymers of vinyl chloride and vinyl acetate, polystyrene, methyl cellulose, ethyl cellulose, cellulose acetate butyrate, cellulose acetate, polyvinylidene chloride, polycarbonate, gelatin and polyvinyl alcohol, etc. The top coat polymer layer may contain a matting agent such as titanium dioxide, kaolin, zinc oxide, silica, alumina, or polysaccharides such as starch, etc., whereby, the materials can be written or printed upon using stamp inks or with a ball point pen or a pencil.

If desired, various additives used for gelatin-silver halide light-sensitive materials, such as antihalation agents, antihalation dyes, whitening dyes, filter dyes, light absorbing materials, fluorescent whitening agents, plasticizers, lubricating agents, surface active agents and hardening agents, etc. can be used in the thermally developable light-sensitive materials of the present invention. If desired, the thermally developable light-sensitive material of the present invention may contain matting agents such as calcium carbonate, starch, titanium dioxide, silica, dextrin, barium sulfate, aluminium oxide, clay, diatomaceous earth or kaolin, etc.

A process for preparing the thermally developable light-sensitive materials of the present invention is summarized as follows. Carboxylic acid silver salts are prepared by reacting carboxylic acids with a silver ion supplying agent such as silver nitrate using one of the above-described various processes. After the resulting silver carboxylates are washed with water or ethyl or isopropyl alcohol, they are dispersed in a binder to prepare a polymer dispersion of the silver salt. The dispersion can be carried out using a colloid mill, a mixer or a ball mill, etc. To the resulting polymer dispersion of the silver salts a silver halide forming agent is added to convert a part of the carboxylic acid silver salts into silver halide. The silver halide may be previously prepared and added thereafter, if desired. The silver halide may be prepared simultaneously with the preparation of the carboxylic acid silver salts as well. Then, additives such as sensitizing dyes, reducing agents and toning agents, etc. are added in turn as a solution. When all additives have been added a coating composition is produced. The resulting coating composition is then applied to a suitable support without drying to form a thermally developable light-sensitive layer. Similarly, a top coat polymer layer, a subbing layer, a back layer and other layers can be formed by preparing coating compositions of each and applying each such composition in turn thereto using various coating methods such as a dip-coating method, an air-knife coating method, a curtain coating method or a hopper coating method, etc. If desired, two or more layers may be applied at the same time using the method described in U.S. Pat. No. 2,761,791 and British Pat. No. 837,095.

If desired, the surface or the back of the support or a layer on the support may be printed, by which it can be utilized for various tickets (e.g., commutation tickets), post cards or other record materials.

The resulting thermally developable light-sensitive material is cut in a size suitable for use and is then imagewise exposed to light. If desired, it may be previously heated (about 80° C. to about 140° C.) before exposure to light. Light sources suitable for the imagewise exposure include various light sources such as a tungsten lamp, a mercury lamp, an iodine lamp, a xenon lamp, a CRT light source and a laser light source, etc. Not only line drawing images but also photographic images containing a gradation may be used as originals. It is possible to use the material to photograph people or a landscape by using a camera. Contact printing may be also carried out by superposing the original on the light-sensitive material. Reflection printing may be carried out as well. Further, enlargement printing may be carried out, if desired. The amount of exposure varies depending on the sensitivity of the light-sensitive materials, and an exposure of about 10 lux-seconds is required with materials having a high sensitivity and an exposure of about $10^4$ lux-seconds is required with materials having a low sensitivity. The light-sensitive material exposed imagewise to light is then heated (about 80° C. to about 180° C. and preferably about 100° C. to about 150° C.) for development. The heating time can be suitably adjusted, for example, in the range of about 1 second to 60 seconds. The heating time is dependent upon the heating temperature. Various heating means may be used. For example, the light-sensitive material may be brought into contact with a heated plate or may be brought into contact with a heated drum. If desired, the light-sensitive material may be passed through a heated space. Further, the light-sensitive material may be heated using high frequency heating or using a laser beam as described in U.S. Pat. No. 3,811,885. In order to prevent a bad odor being generated on heating, a deodorizer may be provided in the processing apparatus. Further, certain kinds of perfumes may be incorporated in the light-sensitive material.

The thermally developable light-sensitive materials of the present invention are very useful, because they have the characteristics that they have a low heat-fogging property, a good stability to light and a good shelf life.

The present invention will be illustrated in greater detail by reference to the following Examples.

COMPARISON EXAMPLE 340g of behenic acid was added to 5000 ml of water and dissolved by heating to 95° C. (Composition A - 1) On the other hand, 20 g of sodium hydroxide was dissolved in 500 ml of water to prepare an aqueous solution. (Composition B).

To Composition A - 1 which was heating to 92° C. with stirring, Composition B was added at a rate of 100 ml per minute. Thus, a dispersion of a sodium behenate-behenic acid mixture was obtained. (Composition C - 1)

Composition C - 1 was cooled to 50° C. and maintained in this state. (stirring was continued.)

On the other hand, 85 g of silver nitrate was dissolved in 500 ml of water to prepare an aqueous solution. (Composition D)

Composition D was added to Composition C - 1 at a rate of 100 ml per minute to produce a dispersion containing silver behenate (Composition E - 1).

The dispersion (Composition E - 1) was stirred at 50° C. for 90 minutes and then allowed to stand. A solution prepared by dissolving 40 g of polyvinyl butyral in 1000 ml of toluene (Composition F) was added and the mixture was stirred at 30° C. for 10 minutes. After being allowed to stand, the liquid phase was removed and the solid phase was separated centrifugally (3000 r.p.m. for 30 minutes). After removing the liquid phase, 400 ml of isopropanol was added to the solid phase. After this was stirred for 10 minutes, it was mixed with a solution prepared by dissolving 270 g of polyvinyl butyral in 1800 ml of isopropanol and the mixture was dispersed for 60 minutes using a homogenizer. Thus, a homogeneous polymer dispersion containing silver behenate and behenic acid (Composition G - 1) was obtained.

Composition G - 1 was maintained at 50° C. with stirring and 160 ml of a 4.2 wt.% solution of N-bromosuccinimide (silver halide forming agent) in acetone was added thereto and allowed to react for 60 minutes, by which silver bromide catalytically contacting a part of the silver behenate was formed.

The thus-prepared polymer dispersion of silver behenate - behenic acid - silver bromide is designated hereinafter Composition H - 1.

EXAMPLE 1

A mixture of 272 g of behenic acid and 82 g of $C_{26}H_{53}$-COOH was added to 5000 ml of water and the resulting mixture was heated to 95° C. to dissolve the components (Composition A - 2).

To Composition A - 2 which was heating to 92° C. with stirring, Composition B, described hereinbefore, was added at a rate of 100 ml per minute. The mixture was cooled to 50° C. and this temperature was maintained (while stirring was continued).

To the resulting Composition C - 2, Composition D, described hereinbefore, was added at a rate of 100 ml per minute to obtain a dispersion containing mixed carboxylic acid silver salts (Composition E - 2).

The dispersion (Composition E - 2) was stirred at 50° C. for 90 minutes and allowed to stand.

A solution prepared by dissolving 40 g of polyvinyl butyral in 1000 ml of toluene (Composition F) was then added thereto and the resulting mixture was stirred at 30° C. for 10 minutes. After being allowed to stand, a liquid phase was centrifugally separated (3000 r.p.m. for 30 minutes). After removing the liquid phase, 400 ml of isopropanol was added to the solid phase. After stirring the solid phase-isopropanol mixture for 10 minutes, a solution prepared by dissolving 270 g of polyvinyl butyral in 1800 ml of isopropanol was added thereto and the resulting mixture was dispersed for 60 minutes using a homogenizer. Thus, a homogeneous polymer dispersion containing carboxylic acid silver salts and carboxylic acids was obtained (Composition G - 2).

To composition G - 2 which was maintained at 50° C. with stirring, 160 ml of a 4.2 wt.% solution of N-bromosuccinimide (silver halide forming agent) in acetone was added and allowed to react for 60 minutes, by which silver bromide catalytically contacting a part of the carboxylic acid silver salts was formed.

The resulting polymer dispersion of carboxylic acid silver salts - carboxylic acids - silver bromide is designated hereinafter Composition H - 2.

EXAMPLE 2

A polymer dispersion of carboxylic acid silver salts - carboxylic acids - silver bromide (Composition H - 3) was produced in the same manner as in Example 1 except that a mixture of 238 g of behenic acid and 123 g of $C_{26}H_{53}COOH$ was used instead of the mixture of 272 g of behenic acid and 82 g of $C_{26}H_{53}COOH$.

EXAMPLE 3

A polymer dispersion of carboxylic acid silver salts - carboxylic acids - silver bromide (Composition H - 4) was produced in the same manner as in Example 1 except that a mixture of 204 g of behenic acid and 164 g of $C_{26}H_{53}COOH$ was used instead of the mixture of 272 g of behenic acid and 82 g of $C_{26}H_{53}COOH$.

EXAMPLE 4

A polymer dispersion of carboxylic acid silver salts - carboxylic acids - silver bromide (Composition H - 5) was produced in the same manner as in Example 1 except that a mixture of 272 g of behenic acid and 82 g of an equimolar mixture of $C_{24}H_{49}COOH$, $C_{26}H_{53}COOH$ and $C_{28}H_{57}COOH$ was used instead of the mixture of 272 g of behenic acid and 82 g of $C_{26}H_{53}COOH$.

EXAMPLE 5

A polymer dispersion of carboxylic acid silver salts - carboxylic acids - silver bromide (Composition H - 6) was produced in the same manner as in Example 1 except that a mixture of 204 g of behenic acid and 164 g of an equimolar mixture of $C_{24}H_{49}COOH$, $C_{26}H_{53}COOH$ and $C_{28}H_{57}COOH$ was used instead of the mixture of 272 g of behenic acid and 82 g of $C_{26}H_{53}COOH$.

EXAMPLE 6

A polymer dispersion of carboxylic acid silver salts - carboxylic acids - silver bromide (Composition H - 7) was produced in the same manner as in Example 1 except that a mixture of 170 g of behenic acid, 37 g of lignoceric acid and 164 g $C_{26}H_{53}COOH$ was used instead of the mixture of 272 g of behenic acid and 82 g of $C_{26}H_{53}COOH$.

EXAMPLE 7

One hundredth of polymer Compositions H - 1 to H - 7 produced in the above described examples were each taken and the following components were added to each dispersion at 30° C. at intervals of 5 minutes to prepare coating compositions, respectively.

(1) Spectral Sensitizing Dye (having the following formula) (0.01 wt.% solution in methyl Cellosolve) 2 ml

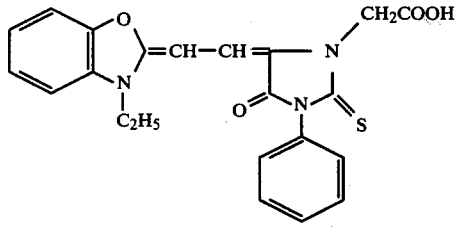

(2) Antifogging Agent
Sodium benzenethiosulfonate
(0.01 wt.% solution in methanol) 2 ml (3) Phthalazinone (color toning agent)
(4.5 wt.% solution in methyl Cellosolve) 5 ml (4) 6-Bromobenzoxazinedione (color toning agent)
(1 wt.% solution in methyl Cellosolve) 6 ml (5) Reducing agent (following formula)
(10 wt.% solution in acetone) 8 ml

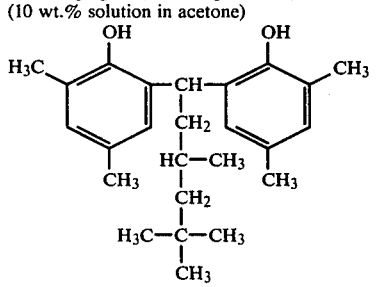

These compositions were each applied to a paper support, both surfaces of which were sized with polyvinyl alcohol, in an amount of 0.4 g per $m^2$ of the paper support and dried at 70° C. for 10 minutes to produce 7 types of thermally developable light-sensitive materials.

Thermally developable light-sensitive material using polymer dispersion Composition H - 1 is designated hereinafter as Sample H - 1. Similarly, the other thermally developable light-sensitive materials produced from the respective polymer dispersions are designated hereinafter as Sample H - 2 to Sample H - 7. After exposing each sample to light from a tungsten lamp through an optical wedge at 3000 lux-seconds, the light-sensitive material was developed by heating to 130° C. for 8 seconds.

On the other hand, each sample was stored in a dark room at 35° C. and 80% RH before exposure. Each sample was then exposed to light in the same manner as described above and developed at 130° C. for 8 seconds. The results obtained are shown in the following table.

Table 1

| Sample No. | Fresh: Light Stability* | Fresh: D max | Fresh: D min | Fresh: Sensitivity** | After Lapse of Time: D max | After Lapse of Time: D min | After Lapse of Time: Sensitivity** |
|---|---|---|---|---|---|---|---|
| H - 1 | 2 | 1.40 | 1.10 | 100 | 0.30 | 0.20 | 1 |
| H - 2 | 3 | 1.40 | 0.09 | 200 | 0.50 | 0.13 | 20 |
| H - 3 | 4 | 1.35 | 0.08 | 250 | 0.75 | 0.11 | 50 |
| H - 4 | 5 | 1.30 | 0.06 | 270 | 0.95 | 0.09 | 55 |
| H - 5 | 3 | 1.40 | 0.09 | 220 | 0.45 | 0.14 | 20 |
| H - 6 | 5 | 1.32 | 0.07 | 300 | 0.90 | 0.10 | 50 |
| H - 7 | 5 | 1.33 | 0.05 | 300 | 1.00 | 0.08 | 45 |

*Light Stability..... Degree of discoloration of sample when exposed to light for 100 seconds at a distance of 10 cm from a mercury lamp (500W). The degree of discoloration is shown as 5 grades, wherein a sample which did not discolor is 5 and a sample which was markedly discolored is 1.

**Sensitivity..... Relative sensitivity based on the sensitivity of fresh Sample H - 1 (the reciprocal of the exposure necessary to produce a density of fog + 0.1) being 100.

D max and D min..... The maximum image density and the minimum image density (namely, heat fog) each measured as a reflection density.

The following conclusions can be drawn from the above described results.

By using the mixture of the two types of carboxylic acid silver salts as in the present invention, the stability to light is improved and heat fogging is reduced. Further the decrease of D max is small and the decrease of sensitivity is small even though the light-sensitive material has been forcibly deteriorated. Further, an increase in heat fogging is inhibited.

EXAMPLE 8

A polymer dispersion Composition G' was produced in the same manner as in Example 1 for comparison except that 410 g of $C_{26}H_{53}COOH$ was used instead of 340 g of behenic acid. 70 wt.% of the polymer dispersion Composition G - 1 and 30 wt.% of the polymer dispersion Composition G' were then mixed.

The resulting mixture was maintained at 50° C. and N-bromosuccinimide was added in the same manner as in the Comparison Example to produce Composition H - 8. To one hundredth of Composition H - 8, components (a) - (e) were added in the same manner as described in Example 7 to produce coating Composition H - 8, and Sample H - 8 was produced in a similar manner to that described above.

The results obtained by processing in the same manner as in Example 7 were as follows.

Table 2

| Sample No. | Fresh: Light Stability | Fresh: D max | Fresh: D min | Fresh: Sensitivity | After Lapse of Time: D max | After Lapse of Time: D min | After Lapse of Time: Sensitivity |
|---|---|---|---|---|---|---|---|
| H - 1 | 2 | 1.40 | 0.10 | 100 | 0.30 | 0.20 | 1 |
| H - 8 | 3 | 1.35 | 0.09 | 200 | 0.55 | 0.13 | 25 |

It can be understood from the above results that the effects of the present invention are exhibited even if each silver salt is previously prepared and mixed thereafter, but such effects are somewhat lower than those of the sample of Composition H - 3.

EXAMPLE 9

A polymer dispersion of carboxylic acids - carboxylic acid silver salts - silver bromide (Composition H - 9) was produced in the same manner as described in Example 1 except that 87.6 g of $C_{28}H_{57}COOH$ was used instead of 82 g of $C_{26}H_{53}COOH$ in the mixture, and a thermally developable light-sensitive material, Sample H - 9, was produced in the same manner as described in Example 7. Sample H - 9 was treated in the same manner as described in Example 7. The results obtained are shown in the following data.

| Sample No. | Light Stability | Fresh D max | Fresh D min | Fresh tivity | After Lapse of Time D max | After Lapse of Time D min | After Lapse of Time Sensitivity |
|---|---|---|---|---|---|---|---|
| H - 9 | 5 | 1.35 | 0.04 | 300 | 1.05 | 0.06 | 60 |

While the invention has been described in detail and with reference to specific embodiments thereof, it will be apparent to one skilled in the art that various changes and modifications can be made therein without departing from the spirit and scope thereof.

What is claimed is:

1. A thermally developable light-sensitive material comprising a support having thereon a layer containing a mixture of (a) an organic silver salt and (b) a photocatalyst, wherein the organic silver salt (a) is a mixture of (i) silver behenate and (ii) an organic silver salt of a straight chain aliphatic carboxylic acid having an odd number of 25 to 29 carbon atoms, wherein the proportion of said organic silver salt (ii) to said organic silver salt (i) ranges from about 5 mol.% to about 50 mol.% and; additionally in said layer or in an adjacent layer, (c) a reducing agent.

2. The light-sensitive material of claim 1, wherein said organic silver salt of a straight chain aliphatic carboxylic acid having an odd number of 25 or more carbon atoms is $C_{24}H_{49}COOAg$, $C_{26}H_{53}COOAg$ or $C_{28}H_{57}COOAg$.

3. The light-sensitive material of claim 1, wherein the proportion of said organic silver salt (ii) to said organic silver salt (i) ranges from 20 mol% to 40 mol% based on the total amount of the organic silver salt (i).

4. The light-sensitive material of claim 1, wherein the total amount of said organic silver salt (i) and said organic silver salt (ii) ranges from about 0.2 g to about 3 g per $m^2$ of the support.

5. The light-sensitive material of claim 1, wherein said photocatalyst is a light sensitive silver halide or a component capable of forming a light sensitive silver halide upon reaction with said organic silver salt (a).

* * * * *